US007609144B2

(12) United States Patent
Lee et al.

(10) Patent No.: US 7,609,144 B2
(45) Date of Patent: Oct. 27, 2009

(54) HIGH RESISTIVITY THIN FILM COMPOSITION AND FABRICATION METHOD

(75) Inventors: Michael Lee, High Wycombe (GB); Steven Wright, Northchurch (GB); Philip Judge, Richmond (GB); Craig Wilson, Livermore, CA (US); Gregory Cestra, Pleasanton, CA (US); Derek Bowers, Los Altos Hills, CA (US)

(73) Assignee: Analog Devices, Inc., Norwood, MA (US)

( * ) Notice: Subject to any disclaimer, the term of this patent is extended or adjusted under 35 U.S.C. 154(b) by 320 days.

(21) Appl. No.: 11/608,668

(22) Filed: Dec. 8, 2006

(65) Prior Publication Data

US 2008/0136579 A1 Jun. 12, 2008

(51) Int. Cl.
*H01C 1/012* (2006.01)

(52) U.S. Cl. ..... 338/308; 338/309; 29/610.1

(58) Field of Classification Search ..... 338/307–309; 29/610.1; 427/58, 101, 125, 209, 335
See application file for complete search history.

(56) References Cited

U.S. PATENT DOCUMENTS

| | | | | |
|---|---|---|---|---|
| 4,391,846 | A | 7/1983 | Raymond | 427/99 |
| 6,129,742 | A | 10/2000 | Wu et al. | 607/1 |
| 6,420,826 | B1 | 7/2002 | Jankowski et al. | 313/495 |

OTHER PUBLICATIONS

Jankowski, A.F. et al.; "TI-CR-AL-O Thin Film Resistors": UCRL-JC-147866; U.S. Department of Energy; University of California; Lawrence Livermore National Laboratory; Mar. 21, 2002; pp. 1-18.

*Primary Examiner*—Kyung Lee
(74) *Attorney, Agent, or Firm*—Koppel, Patrick, Heybl & Dawson

(57) ABSTRACT

A thin film composition is made from silicon, an insulator such as alumina or silicon dioxide, and at least one additional material such as chromium, nickel, boron and/or carbon. These materials are combined to provide a thin film having a ρ of at least 0.02 Ω-cm (typically 0.02-1.0 Ω-cm), and a TCR of less than ±1000 ppm/° C. (typically less than ±300 ppm/° C.). A sheet resistance of at least 20 kΩ/□ may also be obtained. The resulting thin film is preferably at least 200 Å thick, to reduce surface scattering conduction currents.

16 Claims, No Drawings

HIGH RESISTIVITY THIN FILM COMPOSITION AND FABRICATION METHOD

BACKGROUND OF THE INVENTION

1. Field of the Invention

This invention relates generally to thin films, and particularly to thin film compositions and fabrication methods which yield films with high resistivity and a low temperature coefficient of resistance.

2. Description of the Related Art

Integrated circuit (IC) resistors are typically formed from a thin film (TF) material which is deposited on a substrate and formed into features having desired sizes and shapes as needed to provide respective resistances.

Thin films have several characteristics that affect their suitabilty for a particular application. A film's sheet resistance ($R_s$) and resistivity (ρ) determine how much resistance a particular TF feature can provide, while its temperature coefficient of resistance (TCR) describes how the feature's resistance varies with temperature. An ideal TF will have high sheet resistance and resistivity characteristics and a low TCR, thereby minimizing the die area they require and providing a resistance which is stable over temperature.

Conventional TF resistors are made from a composition comprising silicon and chromium (SiCr). Though generally adequate, these resistors have limitations that may make them unsuitable for some applications. For example, battery-powered devices require power consumption to be as low as possible. As current through a resistor is inversely proportional to its value, such applications often require high resistance resistors. However, conventional TF resistors typically have a sheet resistance of 2 kΩ/□ or less, and thus can require an unacceptably large die area to provide a desired resistance value.

In addition, conventional thin films typically have a thickness of about 100 Å. This can result in conduction currents in the TF feature being concentrated near the surface of the material, which can degrade the feature's reliability.

One approach that improves upon conventional thin films is disclosed in U.S. Pat. No. 6,217,722 to Jankowski et al. The films described there comprise titanium, chromium, aluminum and oxygen (Ti—Cr—Al—O), which are said to be capable of providing resistivity values of $10^4$ to $10^{10}$ ohm-cm. However, the described method requires the use of two component gasses (argon and oxygen), and makes no assertions with respect to the TCR of the resulting resistors.

Another approach to thin film resistor fabrication is described in U.S. Pat. No. 6,129,742 to Wu et al. Here, the resulting resistors may possess a relatively low TCR, but only for thin films having a relatively low sheet resistance; higher sheet resistances result in a TCR value which may be unacceptably high.

SUMMARY OF THE INVENTION

The present invention provides a thin film composition and fabrication method which overcomes the problems noted above, providing relatively high resistivity and sheet resistance characteristics, while providing a low TCR.

The present thin film is made from silicon, an insulator such as alumina or silicon dioxide ($SiO_2$), and at least one additional material such as chromium, nickel, boron and/or carbon; several possible compositions are described. These materials are combined to provide a thin film having a ρ of at least 0.02 Ω-cm (typically 0.02-1.0 Ω-cm), and a TCR of less than ±1000 ppm/° C. (typically less than ±300 ppm/° C.). A sheet resistance of at least 20 kΩ/□ may also be obtained. The resulting thin film is preferably at least 200 Å thick, thereby reducing surface scattering conduction currents.

These and other features, aspects, and advantages of the present invention will become better understood with reference to the following description and claims.

DETAILED DESCRIPTION OF THE INVENTION

The present thin film composition and fabrication method provides a thin film having both a relatively high resistivity and low TCR, making the film well-suited for use as integrated circuit resistors. The film is also thermally stable, compatible with standard semiconductor fabrication techniques, and can be made trimmable.

A thin film in accordance with the present invention includes silicon, an insulator, and at least one additional material, which when combined form a thin film having a resistivity (ρ) of at least 0.02 Ω-cm (typically 0.02-1.0 Ω-cm), and a TCR of less than ±1000 ppm/° C., with TCR values of less than ±300 ppm/° C. obtainable. In addition, the film can provide a sheet resistance of at least 5 kΩ/□, with sheet resistances of at least 20 kΩ/□ achievable.

Essential to the present film is the presence of an insulator, preferably alumina ($Al_2O_3$) and/or silicon dioxide ($SiO_2$), and silicon. Using $Al_2O_3$ instead of $SiO_2$ yields resistors that are easier to trim by means of a LASER cutting beam. The "additional material" required can be nickel (Ni), chromium (Cr), boron (B) and/or carbon (C) in various combinations. However, it may be possible to achieve good results with compositions that include other insulators, metals and/or semiconductors.

The present thin film is preferably at least 200 Å thick. This serves to ensure that conduction current in the film is not concentrated at the surface of the film, thereby reducing surface scattering conduction problems that can be found in conventional films.

The thin film is preferably formed by sputtering. The target material comprises the constituents of the thin film: an insulator, suitably $Al_2O_3$, Si, and at least one additional material such as Ni, Cr, B and/or C. The target forms an electrode which is bombarded with energetic ions so that the surface atoms of the target material are ejected into the gas phase in all directions. The ejected ions/atoms which land on a substrate, such as a silicon wafer placed within the sputtering chamber, form the thin film.

The presence of silicon is essential: silicon is required to form an adequate amount of semiconducting or metallic silicides needed to achieve the resistivity and TCR values noted above.

Conventional thin film resistors made from Ni and Cr tend to have a low sheet resistance. However, including an insulator in the composition as described herein acts to increase the resulting film's sheet resistance.

To achieve the best combination of resistivity and TCR properties, the present film should be annealed after it is deposited. The anneal times depend on temperature, but for practical times a temperature of 400-550° C. should be used. The present film has been demonstrated to be thermally stable to at least 550° C.

Thin films made in accordance with the present invention were deposited in a non-loadlock RF sputtering system from targets that consisted of an insulator plus a mixture of metals and semiconductors. The system was generally pumped to a base pressure of $<1\times10^{-6}$ torr. The substrates used were oxidized silicon wafers. The targets were pre-sputtered in argon. Argon was normally used as the sputtering gas, although the addition of small quantities of oxygen to the sputtering gas can be used to increase the final resistance of the film without adversely affecting the TCR. The films were deposited onto unheated oxidized silicon substrates at a thickness of between 15 to 80 nanometers, this lower thickness being determined when surface scattering effects begin to dominate resistance and TCR properties.

A subsequent anneal of the film between 400-550° C. in an inert gas for between 1-4 hours is preferably performed to produce a thermally stable film with suitable electrical characteristics. Depending on the purity of the inert gas, the film may have to be encapsulated with an $SiO_2$ layer or similar barrier layer before anneal to prevent oxidation.

Note that sputtering systems other than a non-loadlock RF type may be used to deposit films with similar properties to those outlined above. Also note that deposition rate, sputtering power, sputtering pressure and target to substrate separation parameters are interrelated, as are substrate temperature during deposition and the temperatures and times of anneal. The process can also be used with other insulating or very high resistance substrates.

Several example compositions and the resistance and TCR characteristics of the resulting films are described below:

EXAMPLE 1

Target composition

Atomic %

Si 17.9; O 18.2; Cr 19.7; C 7.8; B 36.4

Source to substrate distance: 6 cm

Base Pressure: $2.5\times10^{-6}$ torr

Pre Sputter—

Ramp up time: 10 mins.

Presputter time at power: 50 mins.

Presputter Power: 2.9 watts/cm$^2$

Pressure: 10 mtorr

Gas: Ar+1000 ppm $O_2$

Post presputter pressure: $2.0\times10^{-6}$ torr

Sputter—

Time: 5 mins

Power: 2.9 watts/cm$^2$

Pressure: 10 mtorr

Gas: Ar+1000 ppm $O_2$

Substrate temperature: unheated

Post sputter pressure: $6\times10^{7}$ torr

Anneal—

Ramp up time: 45 mins.

Anneal time at temperature: 240 mins.

Temperature: 550° C.

Gas: Ar

Electrical Properties—

Resistance normalized to 40 nm thick film:

Value: 1,975Ω

TCR: −14 ppm/° C.

Note that the sheet resistance for this example was approximately 2 kΩ/□

EXAMPLE 2

Target composition

Atomic %

Si 2.4; O 42.3; Cr 15.4; C 2.0; B 9.6; Al 28.3

Source to substrate distance: 6 cm

Base Pressure: $3.0\times10^{-7}$ torr

Pre sputter—

Ramp up time: 10 mins.

Presputter time at power: 50 mins.

Presputter Power: 2.9 watts/cm$^2$

Pressure: 10 mtorr

Gas: Ar

Post presputter pressure: $1.0\times10^{-7}$ torr

Sputter—

Time: 2.5 mins.

Power: 2.9 watts/cm$^2$

Pressure: 10 mtorr

Gas: Ar

Substrate temperature: unheated

Post sputter pressure: $1.0\times10^{-7}$ torr

Anneal—

Ramp up time: 45 mins.

Anneal time at temperature: 240 mins.

Temperature: 550° C.

Gas: Ar

Electrical Properties—

Resistance normalized to 40 nm thick film:

Value: 12,089Ω

TCR: −177 ppm/° C.

EXAMPLE 3

Target composition

Atomic %

Si 3.9; O 47.0; Cr 7.9; Ni 9.8; Al 31.4

Source to substrate distance: 6 cm

Base Pressure: $4.0\times10^{-7}$ torr

Pre sputter—

Ramp up time: 10 mins.

Presputter time at power: 50 mins.

Pre sputter Power: 2.9 watts/cm$^2$

Pressure: 10 mtorr

Gas: Ar

Post presputter pressure: $1.0\times10^{-7}$ torr

Sputter—

Time: 4.0 mins.

Power: 2.9 watts/$cm^2$

Pressure: 10 mtorr

Gas: Ar

Substrate temperature: unheated

Post sputter pressure: $1.5\times10^{-7}$ torr

Anneal—

Ramp up time: 45 mins.

Anneal time at temperature: 240 mins.

Temperature: 550° C.

Gas: Ar

Electrical Properties—

Resistance normalized to 40 nm thick film:

Value: 12,852Ω

TCR: −28 ppm/° C.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A high resistivity thin film, comprising:

silicon; and an insulator comprising alumina ($Al_2O_3$), silicon dioxide ($SiO_2$), or both; and at least one additional material, said additional materials selected from a group consisting of chromium, nickel, boron and/or carbon, said silicon, insulator and additional materials combined to form a thin film having a resistivity (ρ) of at least 0.02 Ω-cm and a temperature coefficient of resistance (TCR) of less than ±300 ppm/° C.

2. The thin film of claim 1, wherein said thin film has a sheet resistance of at least 5 kΩ/□.

3. The thin film of claim 1, wherein said thin film has a sheet resistance of at least 20 kΩ/□.

4. The thin film of claim 1, wherein said thin film is laser-trimmable.

5. The thin film of claim 1, wherein said thin film is at least 200 Å thick.

6. The thin film of claim 1, wherein said film is annealed after being deposited on a substrate.

7. A high resistivity thin film, comprising:

silicon;

an insulator comprising alumina ($Al_2O_3$), silicon dioxide ($SiO_2$), or both; and at least one additional material, said additional materials selected from a group consisting of chromium, nickel, boron and/or carbon, said silicon, insulator and additional materials combined to form a thin film having a resistivity (ρ) of 0.02-1.0 Ω-cm, a temperature coefficient of resistance (TCR) less than ±300 ppm/° C., and a sheet resistance of at least 5 kΩ/□.

8. A method of forming a high resistivity thin film, comprising:

providing an insulator comprising alumina ($Al_2O_3$), silicon dioxide ($SiO_2$), or both;

providing silicon;

providing at least one additional material, said additional materials selected from a group consisting of chromium, nickel, boron and/or carbon;

combining said insulator, silicon and additional materials to form a thin film;

said providing and combining carried out such that said thin film has a resistivity (ρ) of at least 0.02 Ω-cm and a temperature coefficient of resistance (TCR) less than ±1000 ppm/° C.

9. The method of claim 8, further comprising:

depositing said thin film on a substrate; and annealing said thin film.

10. The method of claim 9, further comprising laser-trimming said deposited and annealed thin film.

11. The method of claim 9, wherein said deposited and annealed thin film is at least 200 Å thick.

12. The method of claim 8, wherein said thin film is formed by sputtering, the target material for said sputtering comprising said insulator, said silicon, and said at least one additional material.

13. The method of claim 12, wherein said target material comprises said insulator, silicon, nickel and chromium.

14. The method of claim 12, wherein said target material comprises said insulator, silicon, chromium, boron and carbon.

15. A method of forming a high resistivity thin film, comprising:

providing an insulator comprising alumina ($Al_2O_3$), silicon dioxide ($SiO_2$), or both;

providing silicon;

providing at least one additional material, said additional materials selected from a group consisting of chromium, nickel, boron and/or carbon;

combining said insulator, silicon and additional materials to form a thin film;

depositing said thin film;

annealing said deposited thin film;

said providing, combining, depositing and annealing being carried out such that said deposited and annealed thin film has a resistivity (ρ) of at least 0.02 Ω-cm and a temperature coefficient of resistance (TCR) less than ±1000 ppm/° C.

16. The method of claim 15, further comprising incorporating oxygen into said thin film during said depositing step.

* * * * *